US005597988A

United States Patent [19]

Skalski

[11] Patent Number: 5,597,988

[45] Date of Patent: Jan. 28, 1997

[54] CONTROL SYSTEM FOR ELEVATOR ACTIVE VIBRATION CONTROL USING SPATIAL FILTERING

[75] Inventor: Clement A. Skalski, Avon, Conn.

[73] Assignee: Otis Elevator Company, Farmington, Conn.

[21] Appl. No.: 636,259

[22] Filed: Apr. 23, 1996

Related U.S. Application Data

[63] Continuation of Ser. No. 220,751, Mar. 31, 1994, abandoned.

[51] Int. Cl.[6] ..... B66B 1/44

[52] U.S. Cl. ..... 187/393; 187/292

[58] Field of Search ..... 187/292, 394, 187/393, 391

[56] References Cited

U.S. PATENT DOCUMENTS 5,027,925 7/1991 Kahkipuro ..... 187/115
5,304,751 4/1994 Skalski et al. ..... 187/115
5,368,132 11/1994 Hollowell et al. ..... 187/393

FOREIGN PATENT DOCUMENTS 0467673 1/1992 European Pat. Off. ..... B66B 11/02
0503972 9/1992 European Pat. Off. .

OTHER PUBLICATIONS

Ronald Grierson, "Electric Lift Equipment for Modern Buildings", pp. 18 and 19, 1923.

*Primary Examiner*—Robert Nappi
*Attorney, Agent, or Firm*—Francis J. Maguire

[57] ABSTRACT

A control system for compensating for horizontal vibrations in a travelling elevator includes at least one horizontal vibration sensor disposed in a plane wherein high frequency vibrations are spatially filtered. Each sensor is provided with a control circuit that provides control signals to actuators associated with roller guide wheels for applying force against a rail as needed to reduce vibrations.

18 Claims, 4 Drawing Sheets

CONTROL SYSTEM FOR ELEVATOR ACTIVE VIBRATION CONTROL USING SPATIAL FILTERING

This application is a continuation of application Ser. No. 08/220,751 filed on Mar. 31, 1994, now abandoned.

FIELD OF THE INVENTION

The present invention generally relates to elevators and, in particular, relates to a control system for elevator active vibration control using spatial filtering.

BACKGROUND OF THE INVENTION

European Patent Application Publication No. 0 467 673 A2, published on Jan. 22, 1992 describes and discusses a method and apparatus for actively counteracting a disturbing force acting horizontally on an elevator platform moving vertically in a hoistway. Therein the horizontal acceleration of the ear is sensed and counteracted, for example, by means of an active roller guide, meaning a conventional roller guide with one or more actuators added thereto. In one embodiment thereof, a roller guide was fitted with two actuators, one for heavy-duty centering and the other for countering high frequency accelerations with much lesser forces. A slower, position-based feedback control loop was disclosed for controlling the high-force, centering actuator. Position and acceleration sensors were disclosed as being positioned at various points in the system, including the floor or roof, but the positions thereof were explicitly indicated as being arbitrary, see page 10, line 33.

In U.S. Pat. No. 5,027,925 there is shown and described a procedure and apparatus for dampening the vibrations of an elevator car. As discussed therein, the elevator is provided with an elastic suspension system and an accelerometer that provides signals to control a counteracting force. The elevator is provided with high pass filters to filter out signal components relating to the elevator's normal travelling acceleration.

One obvious way of implementing such a closed-loop acceleration based control system is to place the accelerometers close to their associated actuators. For an active roller guide system, this suggests mounting the accelerometers on the roller guides themselves.

It is clear from the prior art that the presence of high frequency horizontal accelerations, or vibrations, is a major obstacle that must be overcome in order to provide an improved ride quality. As used in the art, the phrase "high frequency" is generally taken to mean mechanical vibrations having a frequency greater than about 10 Hz. Such high frequency accelerations make the implementation of control loops quite difficult since control loop stabilization is significantly affected by many spurious responses occurring beyond about 20 Hz. Thus, the prior art has addressed this problem with considerable vigor and expense. Unfortunately, the solutions were not feasible because of the inability to remove spurious responses using conventional linear lumped parameter filters.

Consequently, it is necessary to provide an active vibration control system that overcomes the difficulties of the prior art systems.

DISCLOSURE OF INVENTION

Accordingly, an object of the present invention is to provide an improved active control system. According to the present invention, for an elevator active vibration control, spatial filtering is used.

This may be accomplished, at least in part, by mounting accelerometers for an active elevator horizontal suspension control system only in a plane having minimal high frequency vibrations, i.e., a plane wherein high frequency vibrations are spatially filtered.

Other objects and advantages of the present invention will become apparent to those skilled in the art from the following detailed description read in conjunction with the appended claims and the drawings attached hereto.

BRIEF DESCRIPTION OF THE DRAWINGS

The drawings, not drawn to scale, include

BEST MODE FOR CARRYING OUT THE INVENTION

Figure 2:
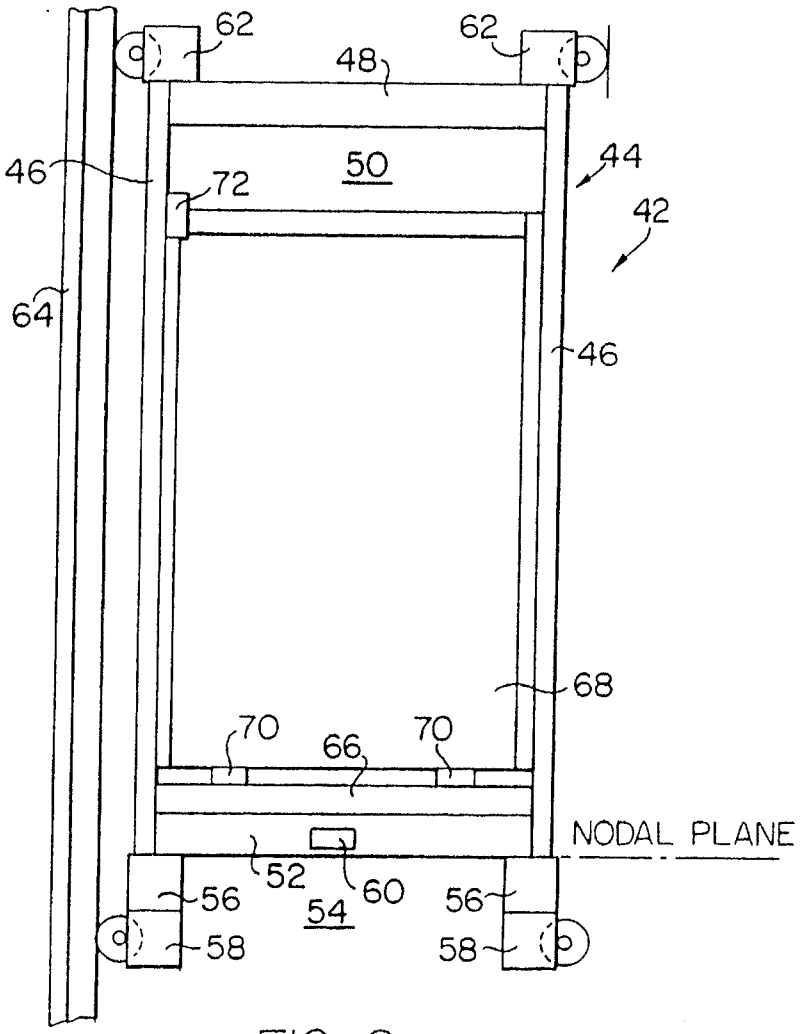
FIG. 2 is a schematic of an elevator car assembly including a motion sensor disposed in accordance with the principles of the present invention.

An active roller guide system, such as known from the above-referenced EPO publication 0 467 673 A2, generally indicated in simplified form at 10 in the drawings, includes a roller wheel 12 adapted to ride along a guide rail 14, is attached to a first link 16 of a control member 18 that pivots at one end 20 thereof. A second link 22 of the control member 18 extends from the pivot point 24 and is controlled by an actuator 26 having a heavy-duty electromechanical actuator 26*a* at the end 28 of the second link 22 distal the pivot point 24 and having a low-force magnetic actuator 26*b* shown near the middle of the second link 22. Typically, the active roller guide system 10 includes a motion sensor, for example, an accelerometer 30 disposed proximate the actuator 26. The active roller guide system 10 includes a control circuit 32 including a controller 34 connected to receive signals from the accelerometer 30 and provide information to a magnet driver 36 of control circuit 32 for controlling the magnetic actuator 26*b*. The control circuit 32 also includes a position sensor 38, a centering controller 40 and the actuator 26*a*. The centering controller 40, provides an output signal to the actuator 26*a* whereby the position of the end 28 of the second link 22 is relatively slowly moved to cause the roller wheel 12 to be forced against the guide rail 14 upon which it rides with more or less force. Similarly, the magnetic actuator acts quickly to counteract relatively low-force vibrations sensed by the accelerometer. In this manner, the vibrations associated with the travelling elevator car are sensed and reduced.

Depicted in FIG. 2 is a representation of an elevator car 42. As shown therein, a car frame 44 includes a plurality of vertical stiles 46 jointed to a crosshead 48 at the top end 50 and to a plank 52, i.e., a safety plank proximate the bottom end 54 of the vertical stiles 46. Jointed to the plank 52 are safeties 56. In this embodiment, active roller guides 58 are attached to the safeties 56 and controlled in the side/side direction by use of an accelerometer 60. Standard roller guides 62 (or other guidance means such as roller guides using centering controls) are affixed to the crosshead 48. These roller guides 62 react against a conventional T-shaped elevator rail 64. FIG. 2 depicts the side to side stabilization axis. The elevator car 42 is, of course, also stabilized in the left front/back and right front/back directions. Hence, three axes of stabilization: side/side, front/back, and rotation about the vertical axis (yaw) are provided.

A platform 66 is joined to the car frame 44 and rests on the plank 52. The platform 66 is braced to the stiles 46 to prevent rotation about a horizontal axis. An elevator cab 68 is secured to the platform 66 through sound isolation pads 70. Rotation of the elevator cab 68 is restrained using steadiers 72.

Each roller is effectively connected to the car frame 44 by means of suspension springs (not shown in FIG. 2). The vibration resonant frequencies about the principle rigid body modes, i.e., side/side, front/back and yaw, are on the order of 1 to 3 Hz. Each vibration mode may be characterized as a second order system defined by a natural (resonant) frequency, effective mass, and damping ratio (zeta=damping constant/[4*π* natural frequency*effective mass]).

Figure 1:
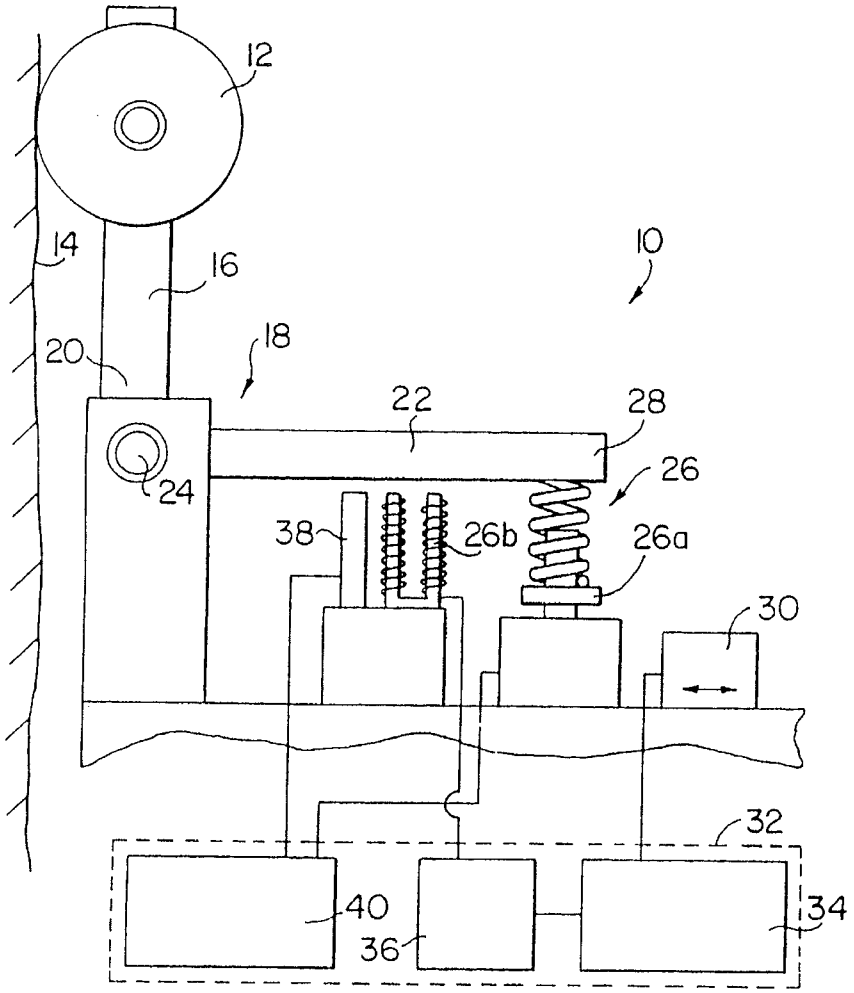
FIG. 1 PRIOR ART
FIG. 1 which is a schematic for a conventional active roller guide system.

Active control is achieved as shown in FIG. 1. The accelerometer output is fed back through a controller 34 and magnet driver 36. The potential success of this control loop may be judged from the acceleration/force transfer function. Ideally, the transfer function G is $$G=s^2/[Ms^2+Ds+K]$$

where

M=effective mass

D=effective damping

K=effective spring rate s=Laplace operator (=jω)

The transfer function G is a good representation of system dynamics for lower frequencies, for example, frequencies below 10 Hz. In the high frequency limit G≅1/M for the ideal system. The function G at higher frequencies is a constant and has a phase of zero degrees.

Figure 3:
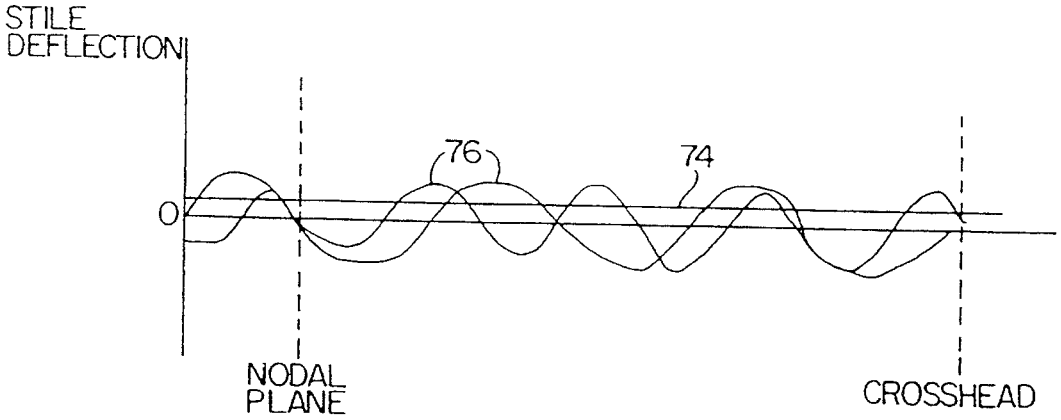
FIG. 3 is a graphic representation of non-rigid body vibration modes attributable to the mechanical system.

At higher frequencies the transfer function G for practical systems has an amplitude considerably larger than 1/M and a phase that lags zero degrees. The high frequency response of G for a practical system is impossible to predict because of the many vibration modes present. These modes are the non-rigid body modes attributable to every part of the mechanical system. The nature of the modes is depicted in FIG. 3. This shows the quasi-rigid-body mode 74 and two high frequency modes 76. Each mode, 74 and 76, has a prescribed spatial orientation and resonant frequency. A practical system has many resonances that appear in the acceleration/force transfer function. The most practical way of dealing with such-resonances is by means of a lag controller. This controller attenuates higher frequencies at the expense of added phase shift. It is well known in control theory that if the total loop gain magnitude exceeds 1.0 when the phase shift goes to 180°, the control is most likely unstable. As used herein, total loop gain is defined as the product of the acceleration/force transfer function times the transfer functions of the magnet driver and controller.

Spatial filtering of acceleration/force responses is a method whereby unwanted responses are eliminated or suppressed without incurring a significant phase lag penalty. The techniques consists of placing accelerometers so that they respond fully to the three primary vibration modes, yet have little response to the spurious modes. In FIG. 3 a nodal plane or region is defined on the plank 52. The plank 52 itself is massive and rigid. Its mass and rigidity are enhanced by the platform 66 and cab 68 resting on it. A point of suppressed (diminished) vibrations is a node. The plank 52 represents a region where strong vibrations cannot exist. The meaning of a nodal point or region is illustrated in FIG. 3. The amplitude of the primary mode is little diminished from the reference point "0", where a force transducer is located, to the nodal plane where an accelerometer is 60 located. The accelerometer 60 has little response to the high-frequency modes.

Figure 4:
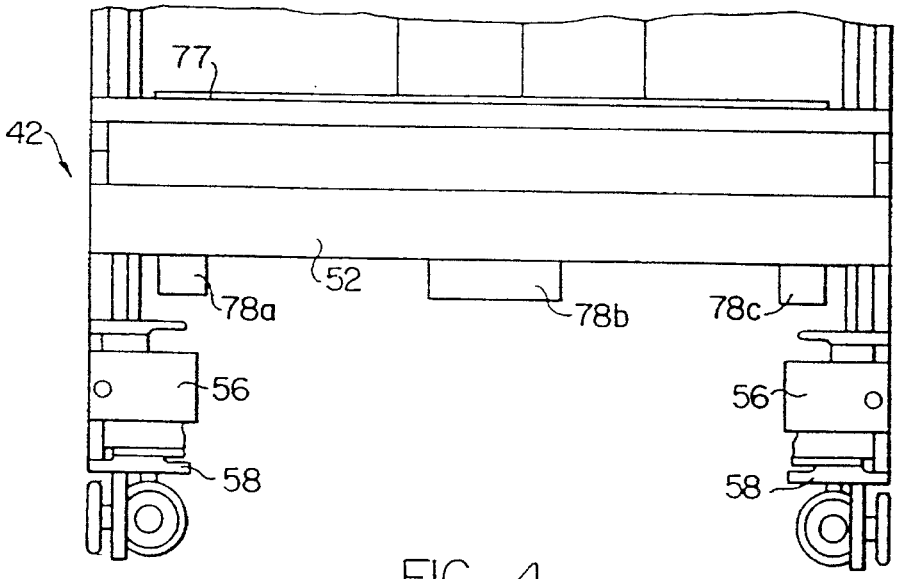
FIG. 4 is a schematic of a portion of an elevator car assembly including a plurality of motion sensors disposed in accordance with the principles of the present invention.

A lower structural portion of the elevator car 42 is shown in FIG. 4 wherein structural elements previously discussed are identified by the same numerals. As shown therein the car 42 includes a floor 77, and the safety plank 52. It has been determined that a horizontal plane of the common node for the high frequency vibrations of the car 42 is substantially coincident with the plane of the plank 52. Hence, as shown in FIG. 4, a plurality of accelerometers **78*a*, 78*b*, and 78*c* are disposed on the plank 52. Because the high frequency vibrations have a common node in this plane, this plane of the elevator car 52 has no significant high frequency vibrational forces acting thereupon. That is, the plane is quiet with respect to high frequency vibrations. Thus, by so disposing the accelerometers 78*a*, 78*b*, and 78*c*, forces due to high frequency vibrations are spatially filtered from the accelerometers 78*a*, 78*b*, and 78*c*. As a consequence, the vibrations predominately detected by the accelerometers 78*a*, 78*b*, and 78*c*** are those due to rigid body mode vibrations.

In the preferred embodiment, one of the accelerometers **78*b* is preferably disposed proximate the horizontal center of the elevator car 42 in the common node plane or as close thereto as practicable. The other two accelerometers, 78*a* and 78*c*, are also placed in the common node plane, to the sides of the elevator car 42 and centered between the front and back walls of the elevator car 42. In such an embodiment, the accelerometers 78*a*, 78*b*, and 78*c* respond primarily to the side-to-side motions, front-to-back motions, and horizontal rotation motions (generally referred to as "yaw"). These motions are generally caused by elevator rail anomalies and aerodynamic forces acting on the car. In the preferred embodiment, the vertical distance between the plank 52 and the active roller guides 58, wherein the actuators 26 are disposed, is minimized to reduce the phase shift between the accelerometers 78*a*, 78*b*, and 78*c*** and the actuators.

Figure 5:
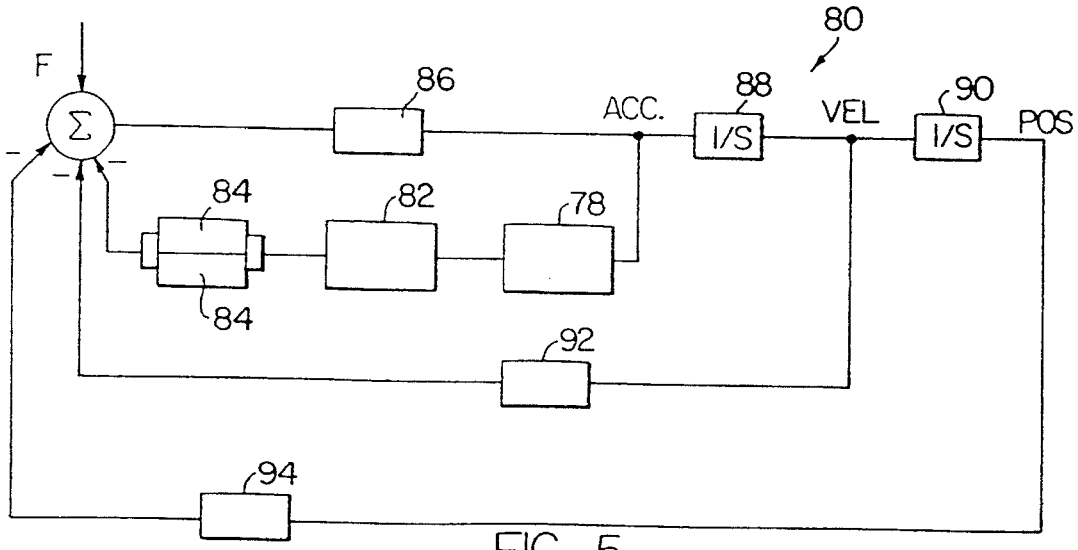
FIG. 5 is an exemplary block diagram of a generalized control system for use with the motion sensors of the present invention.

A simplified vibration control system 80 is shown in FIG. 5. In the preferred embodiment, each accelerometer **78*a*, 78*b*, and 78*c* has, as shown in FIG. 5, a control-loop compensator circuit 82 associated therewith that receives signals from one of the accelerometers 78*a*, 78*b*, and 78*c* and provides compensated signals to one or more magnet driver/actuator assemblies 84 associated with the active roller guides 58. In this fashion, the number of control circuits required is equal to the number of accelerometers 78 rather then the number of roller guide wheels 12 as previously required. The system 80 shows a body force F, such as a wind gust acting on the effective mass 86. In this model the effective mass represents the ability of the elevator car 42 to resist forces acting thereon. In response thereto an accelerometer 78 provides an output signal into the controller circuit 82. The controller circuit 82 outputs a compensating signal to the magnet driver 26***b* of one or more of the actuators 26, shown in FIG. 1, that control the movement of the roller guide wheels 12.

In addition, the system 80 shown in FIG. 5 represents the horizontal velocity of the car as manifested by the system integrating 88 the acceleration which is again integrated 90 to define the position of the car. The car motion is damped by residual mechanical damping means 92 which is part of the elevator system 80. A spring restraint is depicted by position feedback through block 94 to the force summation junction 95.

Because the noise resulting from high frequency vibrations is mitigated by disposing the accelerometers 78*a*, 78*b*, and 78*c* in the common node plane of high frequency vibration, i.e., by spatial filtering, the control system 80, and particularly the accelerometer loop is capable of sufficient loop gains to permit effective closed-loop control of the vibrations. In one particular embodiment, the controller circuit 32 has a transfer function of the form:

$$G_1 = \frac{\text{OUT}}{\text{IN}} = \frac{6.66.\text{Gain}.s}{2s+1} \cdot \frac{10}{.22s+1} \cdot \frac{10}{.022s+1} \cdot \frac{10}{.01s+1}$$

This transfer function cuts off low frequency response to eliminate accelerometer drift effects. Further, it rolls off high frequency response using a cascade of lag sections. This function is stable over the range of vibrational forces to which the accelerometers 78*a*, 78*b*, and 78*c* are subjected when placed in the high frequency vibration spatial filtering common node plane.

Figure 6A:
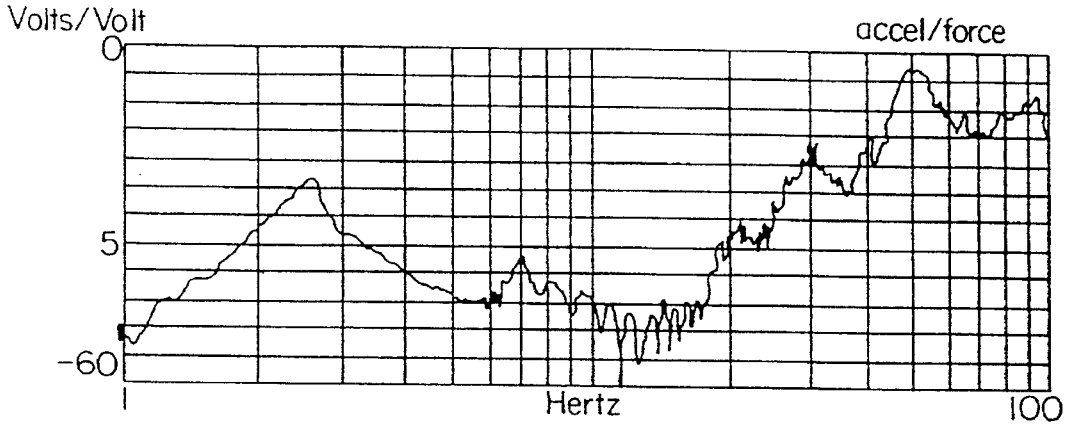
FIG. 6A PRIOR ART
FIGS. 6A and 6B are amplitude and phase plots, respectively, for a elevator system having the accelerometers disposed proximate the roller guides.
Figure 6B:
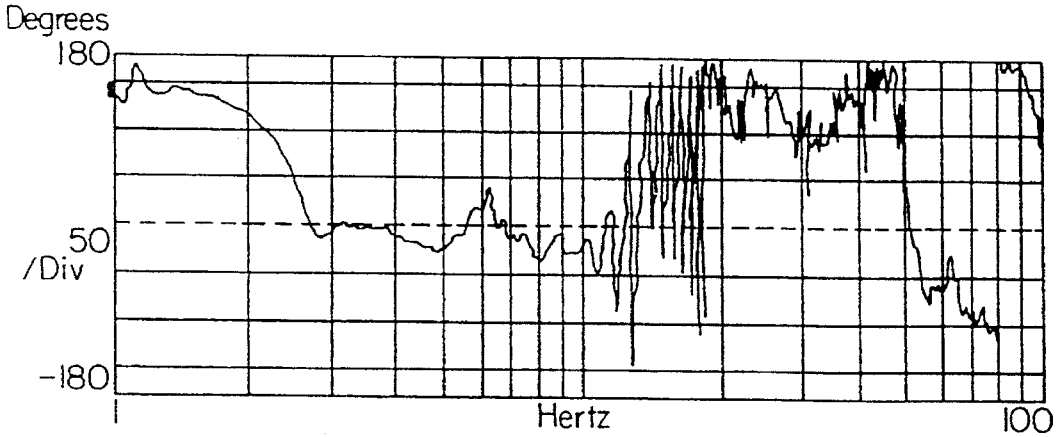
FIG. 6B PRIOR ART
Figure 7A:
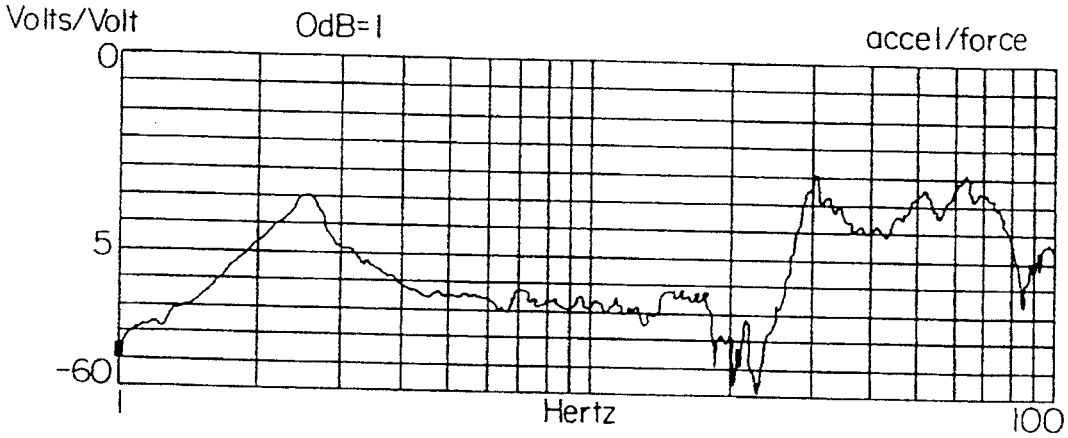
FIGS. 7A and 7B are amplitude and phase plots, respectively, for a elevator system having the accelerometers disposed according to the principles of the present invention.
Figure 7B:
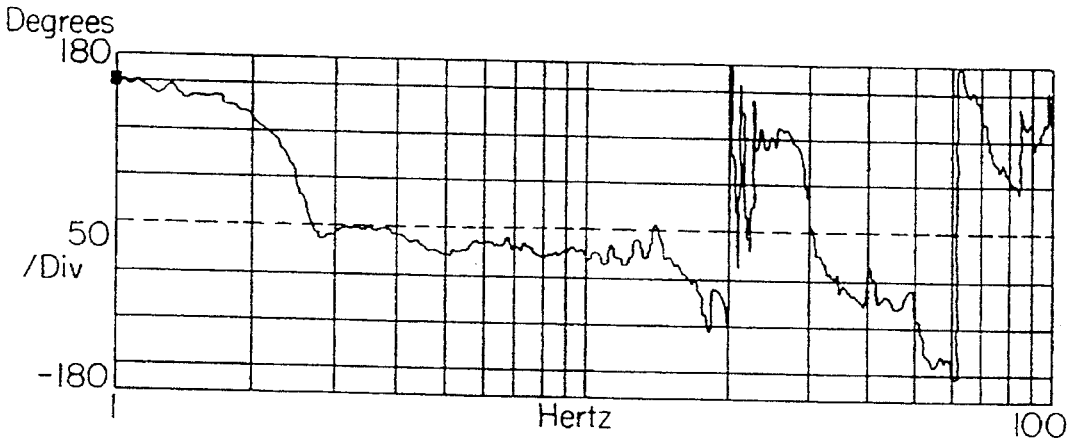

The experimentally obtained transfer function (acceleration/force) shown in FIGS. 6A and 6B graphically depicts shows the prior art sensed vibrations with the accelerometers disposed near or on the actuators, and FIGS. 7A and 7B with the accelerometers disposed in the nodal plane of high frequency vibration spatial filter, reveals that the latter technique significantly reduces the high frequency noise measured. As a result, good closed-loop response is possible for the control systems such as shown in FIG. 5 when the lumped mass M is actually a complex mechanical structure.

Experimental measurements taken of both amplitude (FIG. 6A) and phase (FIG. 6B) show the forces detected when an accelerometer is disposed proximate the roller guide assembly of an elevator. As clearly shown, significantly high signal levels occur as a result of vibrations having frequencies above about 10 Hertz. However, the same measurements, i.e. amplitude (FIG. 7A) and phase (FIG. 7B), taken with the accelerometer disposed in a plane proximate the plane whereat the high frequency vibrations are spatially filtered, show significantly lower signal levels.

From the above, it will be readily understood that the disposition of motion sensors in a plane that spatially filters the forces resulting from high frequency vibrations is distinctly advantageous in that the control system is less noisy and is stable over the range of rigid body vibrations that are to be controlled.

Although the present invention has been described herein with respect to one or more specific configurations, it will be understood that other arrangements and configurations can be made without departing from the spirit and scope hereof. Hence, the present invention is deemed limited only by the appended claims and the reasonable interpretation thereof.

What is claimed is:

1. A control system for damping vibrations in an elevator car, said control system comprising:

a plurality of actuators, each actuator being associated with a roller guide for urging said roller guide against a rail in response to a sensed signal;

a massive and rigid plank arranged on the elevator car for providing a planar region on the elevator car where high frequency vibrational forces acting thereon are spatially filtered out; and means for sensing horizontal force variations, said sensing means being disposed on said massive and rigid plank such that high frequency vibrations are isolated from said sensing means, for providing the sensed signal to said plurality of actuators, the sensed signal having a rigid body mode horizontal vibration component substantially without a high frequency horizontal vibration component.

2. The control system according to claim 1, wherein said means for sensing horizontal force variations includes three accelerometers.

3. The control system according to claim 2, wherein said three accelerometers are disposed on said massive and rigid plank which is arranged below the floor of said elevator car.

4. The control system according to claim 3, wherein the vertical distance between said plurality of actuators and said massive and rigid plank is minimized.

5. The control system according to claim 3, wherein one of said three accelerometers is centered along said massive and rigid plank and centered front to back.

6. The control system according to claim 5, wherein two of said three accelerometers are disposed proximate the ends of said massive and rigid plank and centered front to back.

7. The control system according to claim 2, where said control system further includes at least one control circuit associated with said three accelerometers.

8. An elevator system comprising an elevator car and an active horizontal vibration control for controlling the elevator car traveling up and down an elevator hoistway, comprising:

a massive and rigid plank arranged on the elevator car for providing a planar region on the elevator car where high frequency vibrational forces acting thereon are spatially filtered out; and accelerometer means disposed on said massive and rigid plank, responsive to rigid body mode horizontal vibration of the elevator car, for providing an acceleration signal to said active horizontal vibration control, the acceleration signal having a rigid body mode horizontal vibration component substantially without a high frequency horizontal vibration component.

9. An elevator system according to claim 8, wherein said massive and rigid plank is a safety plank.

10. An elevator system according to claim 9, wherein the planar region of said massive and rigid safety plank is substantially coincident with a horizontal plane of a common node for high frequency vibrations.

11. An elevator system according to claim 10, wherein the elevator system has actuator means, each actuator means being associated with a roller guide for urging said roller guide against a rail in response to the acceleration signal; and said massive and rigid safety plank is arranged at a minimal vertical distance with respect to said actuator means for reducing a phase shift between said massive and rigid safety plank and said actuator means.

12. An elevator system according to claim 8, wherein said accelerometer means responds primarily to side-to-side motions and front-to-back motions.

13. An elevator system according to claim 12, wherein said accelerometer means includes three accelerometers.

14. An elevator system according to claim 9, wherein said massive and rigid safety plank is arranged below a platform of a cab of the elevator car.

15. An elevator system according to claim 14, wherein said accelerometer means has one accelerometer disposed on said massive and rigid safety plank proximate a horizontal center of said elevator car.

16. An elevator system according to claim 15, wherein said accelerometer means has two accelerometers disposed proximate ends of said massive and rigid safety plank and centered front-to-back with respect to walls of the elevator car.

17. An elevator system according to claim 8, wherein said massive and rigid plank is a safety plank substantially coincident with a horizontal plane of a common node for high frequency vibrations.

18. An elevator system according to claim 8, wherein the elevator system has actuator means, each actuator means being associated with a roller guide for urging said roller guide against a rail in response to the acceleration signal; and said massive and rigid plank is a safety plank arranged at a minimal vertical distance with respect to said actuator means for reducing a phase shift between said massive and rigid safety plank and said actuator means.

* * * * *